US008604400B2

(12) United States Patent
Cole

(10) Patent No.: US 8,604,400 B2
(45) Date of Patent: Dec. 10, 2013

(54) MULTILAYER SUSCEPTOR STRUCTURE

(75) Inventor: Lorin R. Cole, Larsen, WI (US)

(73) Assignee: Graphic Packaging International, Inc., Marietta, GA (US)

( * ) Notice: Subject to any disclaimer, the term of this patent is extended or adjusted under 35 U.S.C. 154(b) by 396 days.

(21) Appl. No.: 12/762,417

(22) Filed: Apr. 19, 2010

(65) Prior Publication Data

US 2010/0264135 A1 Oct. 21, 2010

Related U.S. Application Data

(60) Provisional application No. 61/214,106, filed on Apr. 20, 2009.

(51) Int. Cl.
*H05B 6/80* (2006.01)
*B65D 25/00* (2006.01)

(52) U.S. Cl.
USPC ..... 219/730; 219/725; 219/759; 426/107; 426/109

(58) Field of Classification Search
USPC ..... 219/725, 730, 759; 426/107, 109
See application file for complete search history.

(56) References Cited

U.S. PATENT DOCUMENTS

| | | | |
|---|---|---|---|
| 3,662,139 | A | 5/1972 | Love |
| 4,283,427 | A | 8/1981 | Winters et al. |
| 4,398,994 | A | 8/1983 | Beckett |
| 4,552,614 | A | 11/1985 | Beckett |
| 4,883,936 | A | 11/1989 | Maynard et al. |
| 4,896,009 | A | 1/1990 | Pawlowski |
| 4,927,991 | A | 5/1990 | Wendt et al. |
| 4,943,456 | A | 7/1990 | Pollart et al. |
| 5,002,826 | A | 3/1991 | Pollart et al. |
| 5,038,009 | A | 8/1991 | Babbitt |
| 5,079,397 | A | 1/1992 | Keefer |
| 5,118,747 | A | 6/1992 | Pollart et al. |
| 5,177,332 | A | 1/1993 | Fong |
| 5,213,902 | A | 5/1993 | Beckett |
| 5,220,143 | A | 6/1993 | Kemske et al. |
| 5,239,153 | A | 8/1993 | Beckett |
| 5,254,821 | A | 10/1993 | Walters |
| 5,278,378 | A | 1/1994 | Beckett |

(Continued)

FOREIGN PATENT DOCUMENTS

| | | | |
|---|---|---|---|
| JP | 2001-031149 | A | 2/2001 |
| KR | 10-2005-0092380 | A | 9/2005 |

(Continued)

OTHER PUBLICATIONS

International Search Report for PCT/US2010/031541 mailed Nov. 11, 2010.

(Continued)

*Primary Examiner* — Dao H Nguyen
(74) *Attorney, Agent, or Firm* — Womble Carlyle Sandridge & Rice, LLP

(57) ABSTRACT

A microwave heating construct comprises a plurality of heating regions including a first heating region and a second heating region, the first heating region comprising a first layer of microwave energy interactive material, and the second heating region comprising the first layer of microwave energy interactive material and a second layer of microwave energy interactive material, wherein the second heating region is operative for heating, browning, and/or crisping an adjacent food item to a greater extent than the first heating region.

21 Claims, 4 Drawing Sheets

(56) References Cited

U.S. PATENT DOCUMENTS

| | | | |
|---|---|---|---|
| 5,352,465 | A | 10/1994 | Gondek et al. |
| 5,391,864 | A | 2/1995 | Bodor et al. |
| 5,410,135 | A | 4/1995 | Pollart et al. |
| 5,412,187 | A | 5/1995 | Walters et al. |
| 5,466,917 | A | 11/1995 | Matsuki et al. |
| 5,530,231 | A | 6/1996 | Walters et al. |
| 5,565,228 | A | 10/1996 | Gics |
| 5,585,027 | A | 12/1996 | Young |
| 6,133,560 | A | 10/2000 | Zeng et al. |
| 6,204,492 | B1 | 3/2001 | Zeng et al. |
| 6,251,451 | B1 | 6/2001 | Zeng |
| 6,414,290 | B1 | 7/2002 | Cole et al. |
| 6,433,322 | B2 | 8/2002 | Zeng et al. |
| 6,552,315 | B2 | 4/2003 | Zeng et al. |
| 6,677,563 | B2 | 1/2004 | Lai |
| 6,765,182 | B2 | 7/2004 | Cole et al. |
| 7,019,271 | B2 | 3/2006 | Wnek et al. |
| 7,022,959 | B2 | 4/2006 | Cole et al. |
| 7,351,942 | B2 | 4/2008 | Wnek et al. |
| 7,365,292 | B2 | 4/2008 | Cole et al. |
| 7,541,562 | B2 | 6/2009 | Cole et al. |
| 2007/0215611 | A1 | 9/2007 | O'Hagan et al. |
| 2008/0035634 | A1 | 2/2008 | Zeng et al. |
| 2008/0078759 | A1 | 4/2008 | Wnek et al. |
| 2008/0081095 | A1 | 4/2008 | Cole et al. |
| 2008/0230537 | A1 | 9/2008 | Lafferty |
| 2009/0032529 | A1* | 2/2009 | Lafferty ..... 219/730 |
| 2009/0246332 | A1 | 10/2009 | Lai et al. |
| 2011/0024413 | A1* | 2/2011 | Cole ..... 219/730 |
| 2011/0240635 | A1* | 10/2011 | Lafferty et al. ..... 219/759 |

FOREIGN PATENT DOCUMENTS

| | | | |
|---|---|---|---|
| WO | WO 93/09945 | A1 | 5/1993 |
| WO | WO 98/08752 | A2 | 3/1998 |
| WO | WO 98/35887 | A1 | 8/1998 |
| WO | WO 2004/063053 | A1 | 7/2004 |
| WO | WO 2007/127371 | A2 | 11/2007 |

OTHER PUBLICATIONS

Written Opinion for PCT/US2010/031541 mailed Nov. 11, 2010.

* cited by examiner

MULTILAYER SUSCEPTOR STRUCTURE

CROSS-REFERENCE TO RELATED APPLICATION

This application claims the benefit of U.S. Provisional Application No. 61/214,106, filed Apr. 20, 2009, which is incorporated by reference herein in its entirety.

TECHNICAL FIELD

This disclosure relates to various microwave energy interactive structures, packages, or constructs for heating, browning, and/or crisping a food item in a microwave oven.

BACKGROUND

It is known to use a susceptor in food packages for microwavable food items to provide heating, browning, and/or crisping of the surface of the food item. A susceptor is a thin layer of microwave energy interactive material (generally less than about 100 angstroms in thickness, for example, from about 60 to about 100 angstroms in thickness, and having an optical density of from about 0.15 to about 0.35, for example, about 0.17 to about 0.28) that tends to absorb at least a portion of impinging microwave energy and convert it to thermal energy (i.e., heat), which may be transferred to the food item.

In some instances, it may be desirable to provide varying amounts of heating, browning, and/or crisping in particular areas of the food item. For example, a user may perceive that certain portions of a food item should have a first level of heating, browning, and/or crisping, while other areas should have a second level of heating, browning, and/or crisping. Thus, there is a need for susceptor structures, packages, or other constructs that are capable of providing targeted levels of heating, browning, and/or crisping of the food item in one or more desired areas.

SUMMARY

This disclosure relates generally to various microwave energy interactive structures that may be used to form microwave heating packages or other constructs that enhance the heating, browning, and/or crisping of a food item in a microwave oven. The structures include one or more susceptors in a superposed configuration to define different heating regions that control the degree of heating, browning, and/or crisping of the food item in the respective area. For example, where a greater degree of heating, browning, and/or crisping is desired, a greater number of superposed susceptor layers may be used. Conversely, where less heating, browning, and/or crisping is desired, a fewer number of superposed susceptor layers may be used. In some examples, the arrangement of heating regions may be used to simulate the appearance of food items prepared using other conventional heating apparatuses, for example, grills or skillets. In other examples, the arrangement of heating regions may be used to impart a logo, a graphic, product information, or any other indicia to the surface of the food item.

The structure, package, or other construct may be used to prepare various food items in a microwave oven, for example, sandwiches, savory or sweet pastries, breaded food items, or any other food item that desirably is heated, browned, and/or crisped. The construct may be formed at least partially from a disposable material, for example, paper or paperboard.

Additional aspects, features, and advantages of the present invention will become apparent from the following description and accompanying figures.

BRIEF DESCRIPTION OF THE DRAWINGS

The description refers to the accompanying drawings in which like reference characters refer to like parts throughout the several views, and in which.

DESCRIPTION

The present invention may be illustrated further by referring to the figures. For purposes of simplicity, like numerals may be used to describe like features. It will be understood that where a plurality of similar features are depicted, not all of such features necessarily are labeled on each figure. It also will be understood that various components used to form the microwave energy interactive structures may be interchanged. Thus, while only certain combinations are illustrated herein, numerous other combinations and configurations are contemplated by this disclosure.

Figure 1A:
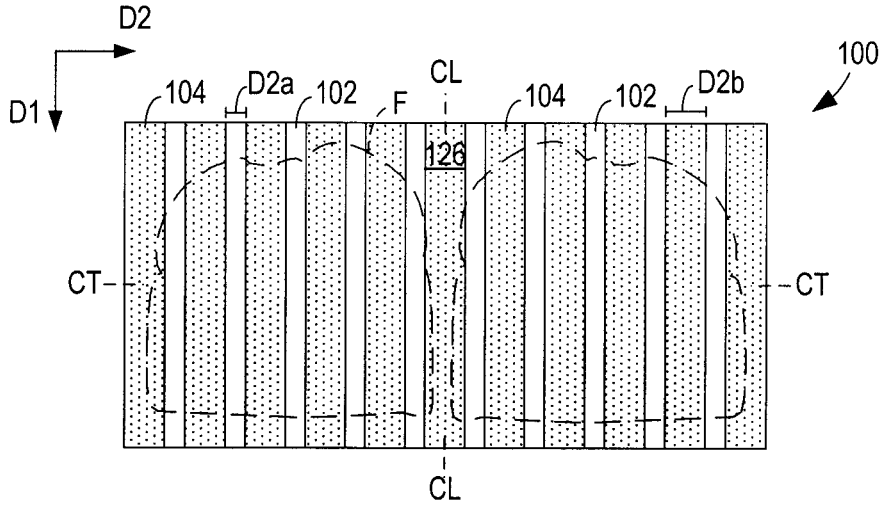
FIG. 1A is a schematic top plan view of an exemplary microwave heating construct for heating, browning, and/or crisping a food item in a microwave oven.
Figure 1B:
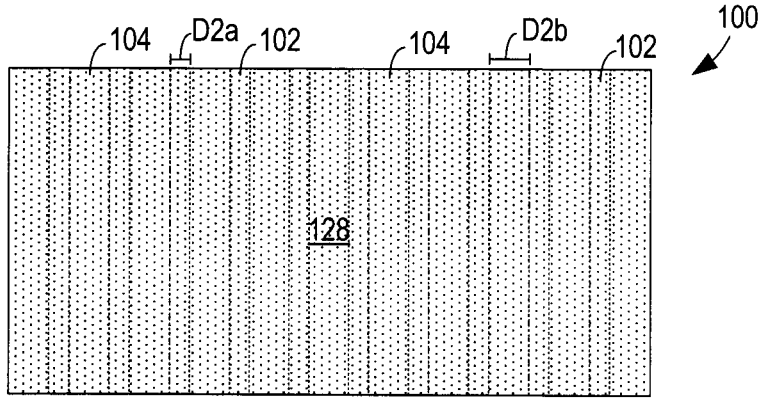
FIG. 1B is a schematic bottom plan view of the construct of FIG. 1A.

FIGS. 1A and 1B schematically illustrate opposite sides of an exemplary microwave heating construct 100 (e.g., a microwave heating card or board) for heating, browning, and/or crisping a food item F (shown schematically with dashed lines) in a microwave oven. In this example, FIG. 1A illustrates a first (e.g., top) side, and FIG. 1B illustrates a second (e.g., bottom) side. However, either side of the construct may be considered the top or bottom side. FIGS. 1A and 1B also may be illustrative of a material and/or blank for forming various packages or other constructs.

The construct 100 and its various features generally have a first dimension, for example, a length, extending in a first direction, for example, a longitudinal direction, D1, and a second dimension, for example, a width, extending in a second direction, for example, a transverse direction, D2. It will be understood that such designations are made only for convenience and do not necessarily refer to or limit the manner in which the construct is manufactured. In some embodiments, the construct 100 may be symmetric or nearly symmetric about a transverse centerline CT and/or along a longitudinal centerline CL.

The construct 100 includes a first plurality of heating areas, zones, or regions 102 and a second plurality of heating areas, zones, or regions 104 (only some of each of which are labeled) generally extending in the first direction D1 along the length of the construct 100 in an alternating configuration. In this example, the second dimension D2*a* of each heating region of the first plurality of heating regions 102 is generally less than the second dimension D2*b* of each heating region of the second plurality of heating regions 104. However, any of the various heating regions may have any desired configuration and/or relative dimensions. The second heating regions 104 are adapted to provide a greater degree of heating, browning, and/or crisping than the first heating regions 102, as will be explained below.

Figure 1C:
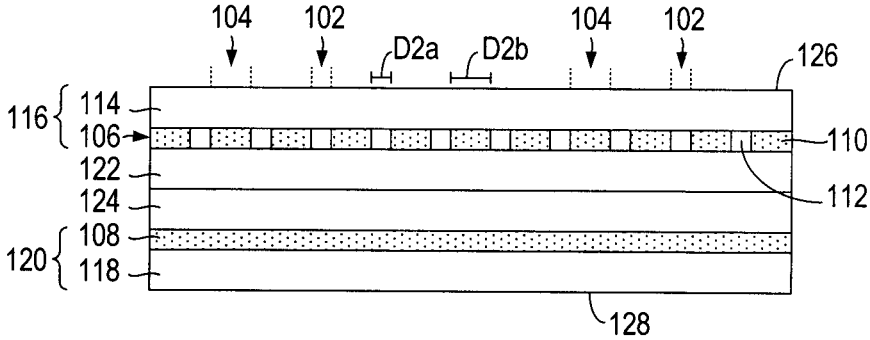
FIG. 1C is a schematic end elevation view of the construct of FIG. 1A.

As shown schematically in FIG. 1C, each of the various heating regions 102, 104 comprises a plurality of adjoined layers working in concert to create the desired heating, browning, and/or crisping effect on the adjacent food item F (FIG. 1A). The plurality of layers generally includes at least two layers that include microwave energy interactive material. For purposes of simplicity, such layers will be referred to as "microwave energy interactive layers", even though portions of such layers may be transparent or substantially transparent to microwave energy.

In the illustrated example, the construct 100 includes a first layer 106 and a second layer 108 that include microwave energy interactive material (shown schematically with stippling throughout the drawings). The first microwave energy interactive layer 106 includes a plurality of microwave energy interactive areas 110 and a plurality of areas 112 that are microwave energy transparent or inactive. Each microwave energy interactive area 110 comprises a microwave energy interactive material 110 operative as a susceptor 110 for converting at least a portion of impinging microwave energy into thermal energy, while the microwave energy transparent areas 112 generally allow microwave energy to be transmitted through the layer. Thus, in some instances, layer 106 may be characterized as a susceptor or susceptor layer that includes (and sometimes circumscribes or surrounds) microwave energy transparent areas 112, a patterned susceptor or susceptor layer, a discontinuous susceptor or susceptor layer, or a partial susceptor or susceptor layer.

Each microwave energy transparent area 112 may be a void formed, for example, by removing microwave energy interactive material chemically or otherwise, or by forming the structure without microwave energy interactive material in the respective area, or may be a portion of the structure formed with a microwave energy interactive material that has been deactivated chemically, mechanically, or otherwise, as will be discussed further below.

In this example, the microwave energy interactive areas 110 and microwave energy transparent areas 112 are arranged in an alternating configuration, with the microwave energy interactive areas 110 having a second dimension D2*b* that is greater than the second dimension D2*a* of microwave energy transparent areas 112. For example, the microwave energy interactive areas 110 may have a second dimension D2*b* of from about 0.25 to about 0.75 inches, for example, about 0.50 inches, while the microwave energy transparent areas 112 may have a second dimension D2*a* of from about 0.10 to about 0.40 inches, for example, about 0.25 inches. It will be appreciated that these dimensions correspond respectively to the dimensions D2*b*, D2*a* of heating regions 104, 102 shown in FIGS. 1A and 1B. However, other configurations are contemplated. For example, in an alternate embodiment, the microwave energy interactive areas 110 may have a second dimension D2*b* that is less than the second dimension D2*a* of microwave energy transparent areas 112.

The second microwave energy interactive layer 108 comprises a substantially continuous layer of microwave energy interactive material 108 operative as a susceptor, such that the microwave energy interactive layer 108 may be referred to, for example, as a susceptor, a susceptor layer, or a substantially continuous susceptor. As is evident in FIG. 1C, the second microwave energy interactive layer 108 is superposed with the both the microwave energy interactive areas 110 and the microwave energy transparent areas 112 of the first microwave energy interactive layer 106. Thus, heating regions 102 include a single layer of microwave energy interactive material 108 and heating regions 104 include two layers of microwave energy interactive material 108, 110 in a generally superposed configuration. However, any number, type, and arrangement of layers may be used to achieve the desired heating, browning, and/or crisping effect for a particular application.

If desired, either microwave energy interactive layer 106, 108 may be supported on a polymer film or other microwave energy transparent substrate for ease of handling and/or to prevent contact between the microwave energy interactive material and the food item. In this example, the first microwave energy interactive layer 106 is supported on a first polymer film 114 layer to define a first, patterned, discontinuous, or partial susceptor film 116. Likewise, the second microwave energy interactive layer 108 may be supported on a second polymer film 118 to define a second, substantially continuous susceptor film 120.

One or both susceptor films 116, 120 may be joined adhesively or otherwise to a support layer, for example, a paper layer, paperboard layer, or another polymer film layer, to impart dimensional stability to the construct 100. In this example, each susceptor film 116, 120 is joined to a respective support layer 122, 124, and the support layers are joined to each other adhesively or otherwise, such that the exposed surfaces of the polymer film layers 114, 118 define outermost and opposite surfaces 126, 128 of the construct 100. However, other numbers and combinations of layers are contemplated. In some cases, the layers of the structure may be rearranged without altering the heating, browning, and/or crisping capabilities of the structure. Further, it will be noted that not all of such layers may be necessary for a particular microwave heating application. For example, in another embodiment (not shown), support layer 122 or 124 may be omitted and the susceptor films 116, 120 may be joined to opposite sides of the same support layer, such that there is only one support layer.

To use the construct 100 according to one exemplary method, the food item may be placed on a food-contacting surface (e.g., surface 126 or 128) of the construct 100. In one particular example, the food item may be a sandwich that has been separated into two sections, each including a piece of bread and one or more toppings in an "open face" configuration. In another example, both the bread and the "filling" of a sandwich may be desirably browned and/or crisped. The filling, for example, a breaded meat item, may be placed on one part of the construct, while the bread may be placed on the other, for example. If desired, the user may be instructed to invert or "flip" one or both items during heating to brown and/or crisp the opposite side of the respective item. Additionally or alternatively, where the sandwich includes two pieces of bread (i.e., the sandwich is a double faced sandwich), the user may be instructed to replace the browned and/or crisped bread with the other piece, so that both pieces may be browned and/or crisped. Numerous other possibilities are contemplated.

Upon sufficient exposure to microwave energy, the susceptors 108, 110 convert at least a portion of the impinging microwave energy to thermal energy, which then can be transferred to the surface of the adjacent food item to enhance browning and/or crisping. Less heat may be generated in the first heating region 102, where only susceptor 108 is present, while more heat may be generated in the second heating region 104, where both susceptors 108, 110 are present. As a result, the food item may be browned and/or crisped less in the areas adjacent to the first heating region, and the food item may be browned and/or crisped more in the areas adjacent to the second region. The overall pattern of browning and/or crisping may resemble grill marks, such that the lighter and darker areas resemble the markings that may be obtained by heating a food item on a grill.

When the heating cycle is complete, the food item may be assembled if needed or desired. For example, where the food item is an open faced sandwich, the components of the sandwich may be stacked on top of one another in a facing relationship to form a double faced sandwich.

Figure 2A:
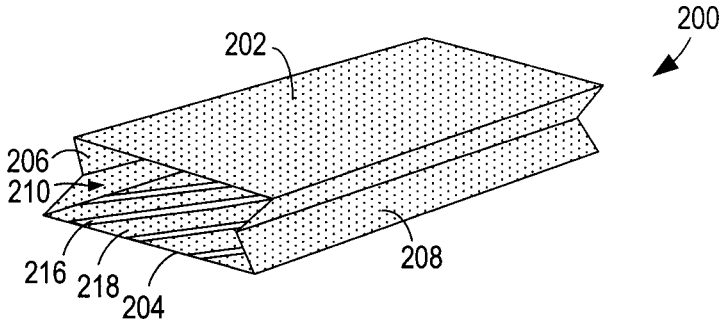
FIG. 2A is a schematic perspective view of an exemplary microwave heating sleeve for heating, browning, and/or crisping a food item in a microwave oven.
Figure 2B:
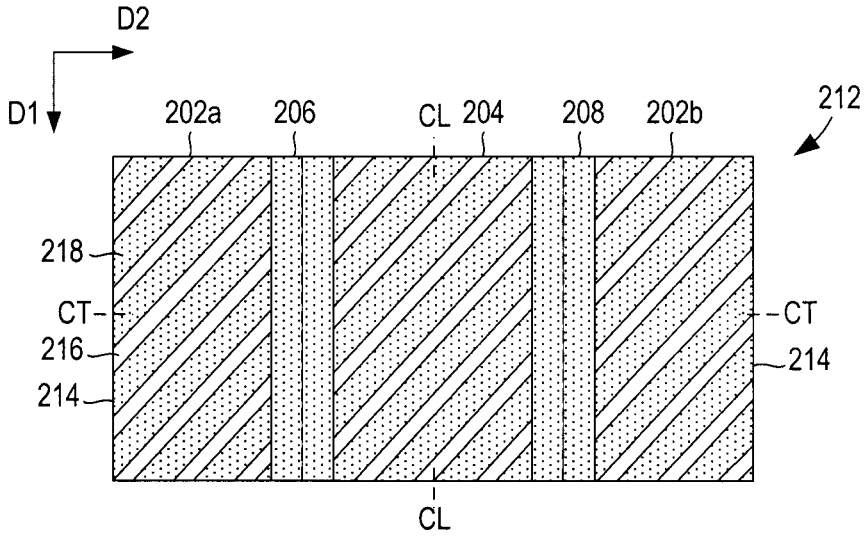
FIG. 2B is a schematic top plan view of an exemplary blank for forming the construct of FIG. 2A.

FIG. 2A schematically illustrates another exemplary construct 200 for preparing a food item in a microwave oven. The construct 200 generally comprises a sleeve with a first pair of opposed panels 202, 204 (e.g., major panels or top and bottom panels) foldably joined to a second pair of opposed panels 206, 208 (e.g., minor panels or side panels). Panels 202, 204, 206, 208 collectively define an interior space 210 for receiving a food item. The construct 200 may be erected from a blank 212, for example, as shown in FIG. 2B, with major panel 202 being formed by overlapping the major panel portions 202*a*, 202*b* with one another and joining the overlapped portions using any suitable mechanism. Alternatively, a flap or any other suitable feature (not shown) may be provided along one or both longitudinal peripheral edges 214 of the blank 212 for being adhered or attached to the opposite end of the blank or to one another to form the sleeve-like structure 200. The blank 212 is like the construct (or blank) 100, except for variations noted and variations that will be apparent to one of ordinary skill in the art.

The blank 212 (and therefore construct 200) includes a first plurality of heating regions 216 and a second plurality of heating regions 218 (only some of each of which are labeled) generally extending obliquely and alternately across the panels 202*a*, 202*b*, 204 (or major panels 202, 204 of construct 200). Panels 206, 208 also include the second heating region 218. The second heating regions 218 are operative for generating more thermal energy than the first heating regions 216, as will be explained further below.

Figure 2C:
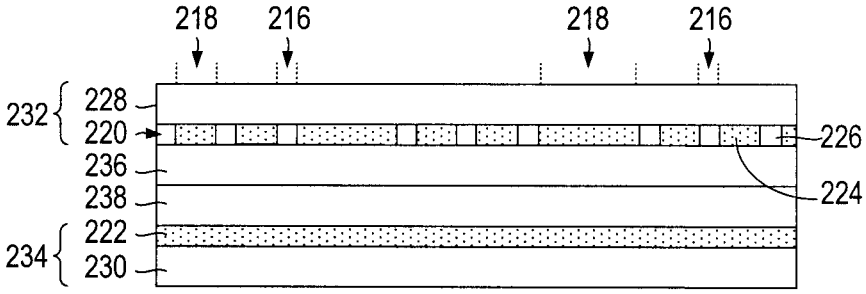
FIG. 2C is a schematic end elevation view of the blank of FIG. 2B.

As shown schematically in cross-sectional view in FIG. 2C, each of the various heating regions 216, 218 comprises a plurality of adjoined layers including a first microwave energy interactive layer 220 and a second microwave energy interactive layer 222. The first microwave energy interactive layer 220 includes a plurality of microwave energy interactive areas 224 (shown schematically with stippling in FIGS. 2A and 2C) and a plurality of microwave energy transparent areas 226, such that the microwave energy interactive layer 220 can be characterized, for example, as a "discontinuous susceptor", similar to layer 106 discussed in connection with FIGS. 1A-1C. Likewise, the microwave energy transparent areas 226 may generally comprise voids, or may comprise a microwave energy transparent material, as described above with respect to layer 106.

The second microwave energy interactive layer 222 comprises a substantially continuous layer of microwave energy interactive material operative as a susceptor (shown schematically with stippling in FIGS. 2A-2C), such that the microwave energy interactive layer 222 is similar to susceptor 108 discussed in connection with FIGS. 1A-1C. The second susceptor 222 is superposed with both the microwave energy interactive areas 224 and the microwave energy transparent areas 226 of the first microwave energy interactive layer 220. Thus, the first heating region 216 includes one susceptor layer 222 and the second heating region 218 includes two susceptor layers 222, 224 in a generally superposed configuration. Each microwave energy interactive layer 216, 218 is supported on a respective polymer film layer 228, 230 to define a respective susceptor films 232, 234. The susceptor films 232, 234 are joined respective support layers 236, 238, which are joined to one another adhesively or otherwise.

When the blank 212 is formed into the construct 200, the major panels 202, 204 include the first and second heating regions 216, 218, while the minor panels 206, 208 include only the second heating region 218. Thus, the areas of the food item adjacent to the major panels 202, 204 will be subject to two different levels of heating, browning, and/or crisping, while the sides of the food item adjacent to panels 206, 208 will be subject to a uniform level of heating, browning, and/or crisping. As such, the resulting pattern of browning and/or crisping on the upper and lower surface of the food item may generally resemble oblique grill marks, while the sides of the food item may be browned and/or crisped in a substantially continuous manner.

Figure 3A:
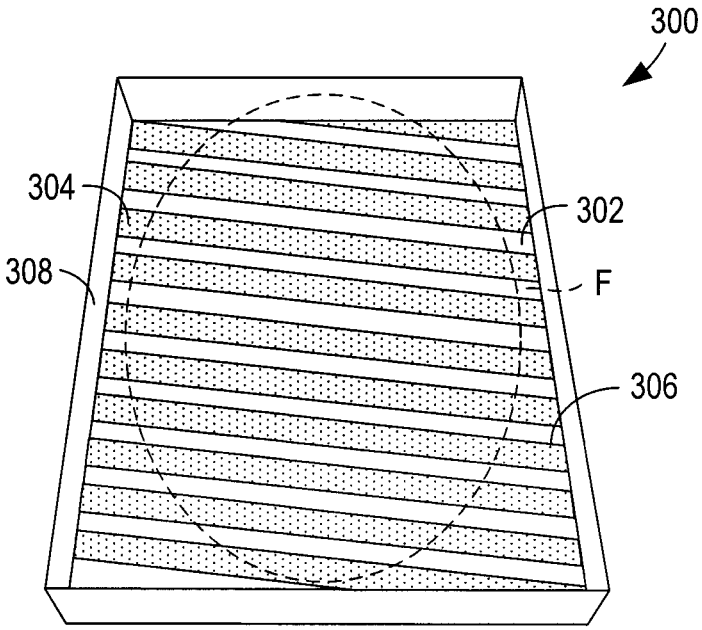
FIGS. 3A and 3B are schematic perspective views of opposite sides of a microwave heating tray for heating, browning, and/or crisping a food item in a microwave oven.
Figure 3B:
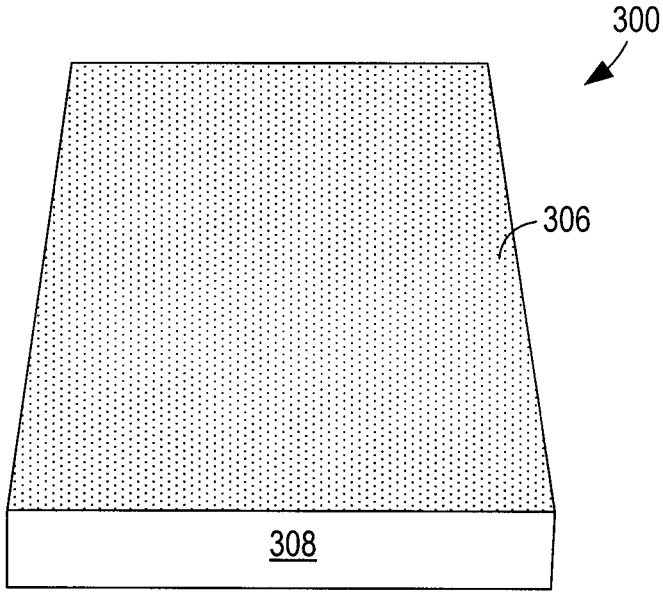

Numerous other microwave heating constructs are encompassed by the disclosure. For example, FIGS. 3A and 3B schematically illustrate opposite sides of a microwave heating tray 300 including a plurality of heating regions 302, 304 configured in a pattern of alternating stripes, for example, alternating oblique stripes, similar to that of construct 200 of FIG. 2A, with heating region 304 being operative for providing greater heating, browning, and/or crisping than heating region 302. The tray 300 includes a base 306 for receiving the food item F (shown schematically with dashed lines) and a plurality of walls 308. In this example, the walls 308 are shown to be microwave energy transparent. However, it will be appreciated that the walls 308 may include one or more layers of microwave energy interactive material for heating, browning, and/or crisping the sides of the food item.

Figure 4A:
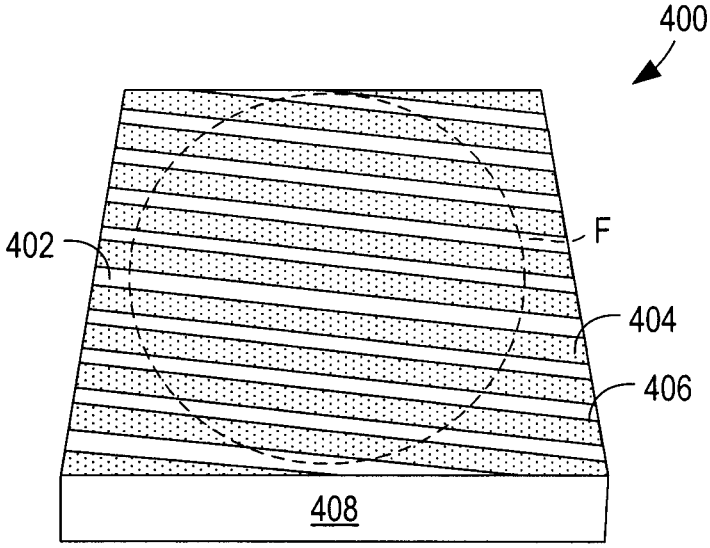
FIGS. 4A and 4B are schematic perspective views of opposite sides of a microwave heating platform for heating, browning, and/or crisping a food item in a microwave oven.
Figure 4B:
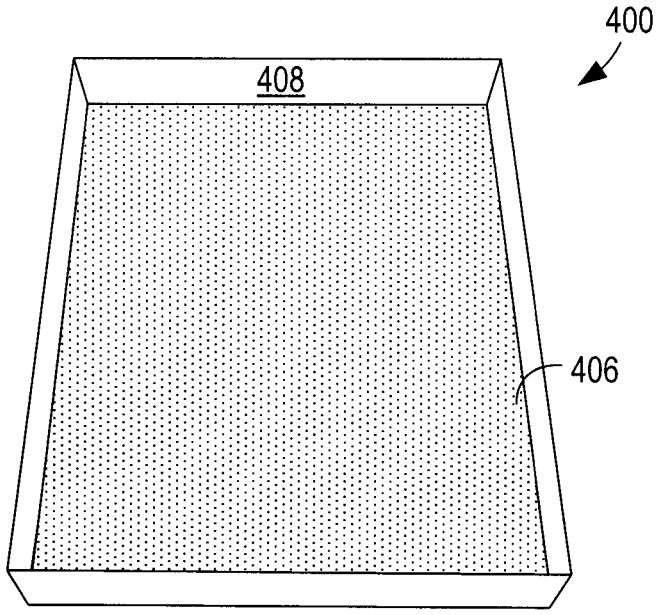

Likewise, FIGS. 4A and 4B schematically illustrate opposite sides of a microwave heating construct 400 including a plurality of heating zones 402, 404 configured in a pattern of alternating stripes, for example, alternating oblique stripes, similar to that of construct 300 of FIG. 3A, with heating region 404 being operative for providing greater heating, browning, and/or crisping than heating region 402. In this example, the construct 400 includes a platform 406 elevated from the floor (or turntable) of the microwave oven by a plurality of support elements or legs 408 to provide insulation from the microwave heating environment, which may enhance heating, browning, and/or crisping of the food item. However, numerous other constructs and packages are contemplated. Further, although the illustrated examples each include one substantially continuous susceptor and one discontinuous susceptor, numerous other susceptor arrangements are contemplated. For example, a construct may include two or more discontinuous layers with various overlapping regions that provide various degrees of heating, browning, and/or crisping of the adjacent food item.

Any of such structures may be formed from various materials, provided that the materials are substantially resistant to softening, scorching, combusting, or degrading at typical microwave oven heating temperatures, for example, at from about 250° F. to about 425° F. The materials may include microwave energy interactive materials, for example, those used to form susceptors and other microwave energy interactive elements, and microwave energy transparent or inactive materials, for example, those used to form the remainder of the construct.

The microwave energy interactive material may be an electroconductive or semiconductive material, for example, a vacuum deposited metal or metal alloy, or a metallic ink, an organic ink, an inorganic ink, a metallic paste, an organic paste, an inorganic paste, or any combination thereof. Examples of metals and metal alloys that may be suitable include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide, for example, oxides of aluminum, iron, and tin, optionally used in conjunction with an electrically conductive material. Another metal oxide that may be suitable is indium tin oxide (ITO). ITO has a more uniform crystal structure and, therefore, is clear at most coating thicknesses.

Alternatively still, the microwave energy interactive material may comprise a suitable electroconductive, semiconductive, or non-conductive artificial dielectric or ferroelectric. Artificial dielectrics comprise conductive, subdivided material in a polymeric or other suitable matrix or binder, and may include flakes of an electroconductive metal, for example, aluminum.

In other embodiments, the microwave energy interactive material may be carbon-based, for example, as disclosed in U.S. Pat. Nos. 4,943,456, 5,002,826, 5,118,747, and 5,410,135.

In still other embodiments, the microwave energy interactive material may interact with the magnetic portion of the electromagnetic energy in the microwave oven. Correctly chosen materials of this type can self-limit based on the loss of interaction when the Curie temperature of the material is reached. An example of such an interactive coating is described in U.S. Pat. No. 4,283,427.

While susceptors are described in detail herein, it will be appreciated that the construct may include other microwave energy interactive elements.

By way of example, the construct may include a foil or high optical density evaporated material having a thickness sufficient to reflect a substantial portion of impinging microwave energy. Such elements typically are formed from a conductive, reflective metal or metal alloy, for example, aluminum, copper, or stainless steel, in the form of a solid "patch" generally having a thickness of from about 0.000285 inches to about 0.005 inches, for example, from about 0.0003 inches to about 0.003 inches. Other such elements may have a thickness of from about 0.00035 inches to about 0.002 inches, for example, 0.0016 inches.

In some cases, microwave energy reflecting (or reflective) elements may be used as shielding elements where the food item is prone to scorching or drying out during heating. In other cases, smaller microwave energy reflecting elements may be used to diffuse or lessen the intensity of microwave energy. One example of a material utilizing such microwave energy reflecting elements is commercially available from Graphic Packaging International, Inc. (Marietta, Ga.) under the trade name MicroRite® packaging material. In other examples, a plurality of microwave energy reflecting elements may be arranged to form a microwave energy distributing element to direct microwave energy to specific areas of the food item. If desired, the loops may be of a length that causes microwave energy to resonate, thereby enhancing the distribution effect. Microwave energy distributing elements are described in U.S. Pat. Nos. 6,204,492, 6,433,322, 6,552,315, and 6,677,563, each of which is incorporated by reference in its entirety.

In still another example, the construct may include a microwave energy interactive insulating material. Examples of such materials are provided in U.S. Pat. No. 7,019,271, U.S. Pat. No. 7,351,942, and U.S. Patent Application Publication No. 2008/0078759 A1, published Apr. 3, 2008, each of which is incorporated by reference herein in its entirety.

As discussed above, any of the numerous microwave energy interactive elements (e.g., susceptors, foils, and so on) described herein or contemplated hereby may be substantially continuous, that is, without substantial breaks or interruptions, or may be discontinuous, for example, by including one or more breaks or apertures that transmit microwave energy. The breaks or apertures may extend through the entire structure, or only through one or more layers. The number, shape, size, and positioning of such breaks or apertures may vary for a particular application depending on the type of construct being formed, the food item to be heated therein or thereon, the desired degree of heating, browning, and/or crisping, whether direct exposure to microwave energy is needed or desired to attain uniform heating of the food item, the need for regulating the change in temperature of the food item through direct heating, and whether and to what extent there is a need for venting.

By way of illustration, a microwave energy interactive element (e.g., a susceptor 108, 110, 222, 224) may include one or more transparent areas (e.g., microwave energy transparent areas 112, 226) to provide dielectric heating of the food item. However, where the microwave energy interactive element comprises a susceptor, such apertures decrease the total microwave energy interactive area, and therefore, decrease the amount of microwave energy interactive material available for heating, browning, and/or crisping the surface of the food item. Thus, the relative amounts of microwave energy interactive areas and microwave energy transparent areas must be balanced to attain the desired overall heating characteristics for the particular food item.

In some embodiments, one or more portions of the susceptor may be designed to be microwave energy inactive to ensure that the microwave energy is focused efficiently on the areas to be heated, browned, and/or crisped, rather than being lost to portions of the food item not intended to be browned and/or crisped or to the heating environment.

In other embodiments, it may be beneficial to create one or more discontinuities or inactive regions to prevent overheating or charring of the food item and/or the construct including the susceptor. By way of example, the susceptor may incorporate one or more "fuse" elements that limit the propagation of cracks in the susceptor structure, and thereby control overheating, in areas of the susceptor structure where heat transfer to the food is low and the susceptor might tend to become too hot. The size and shape of the fuses may be varied as needed. Examples of susceptors including such fuses are provided, for example, in U.S. Pat. No. 5,412,187, U.S. Pat. No. 5,530,231, U.S. Patent Application Publication No. US 2008/0035634A1, published Feb. 14, 2008, and PCT Application Publication No. WO 2007/127371, published Nov. 8, 2007, each of which is incorporated by reference herein in its entirety.

In the case of a susceptor, any of such discontinuities or apertures may comprise a physical aperture or void in one or more layers or materials used to form the structure or construct, or may be a non-physical "aperture" (e.g., microwave energy transparent areas 112, 226), as discussed above. A non-physical aperture is a microwave energy transparent area that allows microwave energy to pass through the structure without an actual void or hole cut through the structure. Such areas may be formed by simply not applying microwave energy interactive material to the particular area, by removing microwave energy interactive material from the particular area, or by mechanically deactivating the particular area (rendering the area electrically discontinuous). Alternatively, the areas may be formed by chemically deactivating the microwave energy interactive material in the particular area, thereby transforming the microwave energy interactive material in the area into a substance that is transparent to microwave energy (i.e., microwave energy inactive). While both physical and non-physical apertures allow the food item to be heated directly by the microwave energy, a physical aperture also provides a venting function to allow steam or other vapors or liquids released from the food item to be carried away from the food item.

As stated above, the microwave energy interactive element may be supported on a microwave inactive or transparent substrate 114, 118, 228, 230 (FIGS. 1C and 2C), for example, a polymer film or other suitable polymeric material, for ease of handling and/or to prevent contact between the microwave energy interactive material and the food item. The outermost surface of the polymer film may define at least a portion of the food-contacting surface of the package (e.g., surface 126 of polymer film 114). Examples of polymer films that may be suitable include, but are not limited to, polyolefins, polyesters, polyamides, polyimides, polysulfones, polyether ketones, cellophanes, or any combination thereof. In one particular example, the polymer film comprises polyethylene terephthalate. The thickness of the film generally may be from about 35 gauge to about 10 mil. In each of various examples, the thickness of the film may be from about 40 to about 80 gauge, from about 45 to about 50 gauge, about 48 gauge, or any other suitable thickness. Other non-conducting substrate materials such as paper and paper laminates, metal oxides, silicates, cellulosics, or any combination thereof, also may be used.

If desired, the polymer film may undergo one or more treatments to modify the surface prior to depositing the microwave energy interactive material onto the polymer film. By way of example, and not limitation, the polymer film may undergo a plasma treatment to modify the roughness of the surface of the polymer film. While not wishing to be bound by theory, it is believed that such surface treatments may provide a more uniform surface for receiving the microwave energy interactive material, which in turn, may increase the heat flux and maximum temperature of the resulting susceptor structure. Such treatments are discussed in U.S. patent application Ser. No. 12/709,578, filed Feb. 22, 2010, which is incorporated by reference herein in its entirety.

The microwave energy interactive material may be applied to the substrate in any suitable manner, and in some instances, the microwave energy interactive material is printed on, extruded onto, sputtered onto, evaporated on, or laminated to the substrate. The microwave energy interactive material may be applied to the substrate in any pattern, and using any technique, to achieve the desired heating effect of the food item. For example, the microwave energy interactive material may be provided as a continuous or discontinuous layer or coating including circles, loops, hexagons, islands, squares, rectangles, octagons, and so forth.

Various materials may serve as the base material 122, 124, 236, 238 (FIGS. 1C and 2C) for the construct 100, 200. For example, the construct may be formed at least partially from a polymer or polymeric material. As another example, all or a portion the construct may be formed from a paper or paperboard material. In one example, the paper has a basis weight of from about 15 to about 60 lbs/ream (lb/3000 sq. ft.), for example, from about 20 to about 40 lbs/ream. In another example, the paper has a basis weight of about 25 lbs/ream. In another example, the paperboard having a basis weight of from about 60 to about 330 lbs/ream, for example, from about 155 to about 265 lbs/ream. In one particular example, the paperboard has a basis weight of about 175 lbs/ream. The paperboard generally may have a thickness of from about 6 to about 30 mils, for example, from about 14 to about 24 mils. In one particular example, the paperboard has a thickness of about 16 mils. Any suitable paperboard may be used, for example, a solid bleached or solid unbleached sulfate board, such as SUS® board, commercially available from Graphic Packaging International.

The construct may be formed according to numerous processes known to those in the art, including using adhesive bonding, thermal bonding, ultrasonic bonding, mechanical stitching, or any other suitable process. Any of the various components used to form the construct may be provided as a sheet of material, a roll of material, or a die cut material in the shape of the package to be formed (e.g., a blank).

The disclosure may be understood further from the following example, which is not intended to be limiting in any manner.

EXAMPLE

Various microwave heating constructs were evaluated in 1200 W and 1300 W ovens. A first construct was similar to the construct of FIGS. 1A-1C. A second construct was similar to the first construct, except that the respective widths of the heating regions were reversed.

In each evaluation, a refrigerated meat and cheese sandwich was heated on the construct in an open faced configuration for about 1 minute and 45 seconds. The construct was placed directly on the turntable of the microwave oven. Both pieces of bread of each sandwich were browned and crisped in a pattern that resembled grill marks. The remainder of the sandwich was heated properly.

While the present invention is described herein in detail in relation to specific aspects and embodiments, it is to be understood that this detailed description is only illustrative and exemplary of the present invention and is made merely for purposes of providing a full and enabling disclosure of the present invention and to set forth the best mode of practicing the invention known to the inventors at the time the invention was made. The detailed description set forth herein is illustrative only and is not intended, nor is to be construed, to limit the present invention or otherwise to exclude any such other embodiments, adaptations, variations, modifications, and equivalent arrangements of the present invention. All directional references (e.g., upper, lower, upward, downward, left, right, leftward, rightward, top, bottom, above, below, vertical, horizontal, clockwise, and counterclockwise) are used only for identification purposes to aid the reader's understanding of the various embodiments of the present invention, and do not create limitations, particularly as to the position, orientation, or use of the invention unless specifically set forth in the claims. Joinder references (e.g., joined, attached, coupled, connected, and the like) are to be construed broadly and may include intermediate members between a connection of elements and relative movement between elements. As such, joinder references do not necessarily imply that two elements are connected directly and in fixed relation to each other. Further, various elements discussed with reference to the various embodiments may be interchanged to create entirely new embodiments coming within the scope of the present invention.

What is claimed is:

1. A microwave heating construct, comprising:

a first layer including a plurality of elongate microwave energy transparent areas and a plurality of elongate microwave energy interactive areas arranged in an alternating configuration; and a second layer including a microwave energy interactive area, the microwave energy interactive area of the second layer being superposed with the microwave energy transparent areas and the microwave energy interactive areas of the first layer, wherein the microwave energy interactive areas of the first layer and the second layer comprise a microwave energy interactive material operative for converting at least a portion of impinging microwave energy into thermal energy, the elongate microwave energy transparent areas of the first layer comprise the microwave energy interactive material in a deactivated condition, the microwave energy transparent areas of the first layer have a width of from about 0.10 to about 0.40 inches, and the microwave energy interactive areas of the first layer have a width of from about 0.25 to about 0.75 inches.

2. The construct of claim 1, wherein the microwave energy transparent areas and the plurality of microwave energy interactive areas are arranged as a plurality of alternating stripes.

3. The construct of claim 1, wherein the microwave energy transparent areas of the first layer have a width of about 0.25 inches and the microwave energy interactive areas of the first layer have a width of about 0.50 inches.

4. The construct of claim 1, wherein the microwave energy transparent areas of the first layer define a first plurality of heating regions, and the microwave energy interactive areas of the first layer define a second plurality of heating regions, the second plurality of heating regions being operative for heating, browning, and/or crisping an adjacent food item to a greater extent than the first plurality of heating regions.

5. The construct of claim 1, wherein the microwave energy interactive material of the first layer is supported on a first polymer film, the first polymer film defining a first side of the microwave heating construct, the first side of the microwave heating construct being for contacting a food item to be heated, browned, and or crisped.

6. The construct of claim 5, wherein the microwave energy interactive material of the second layer is supported on a second polymer film, the second polymer film defining a second side of the microwave heating construct opposite the first side of the microwave heating construct, the second side of the microwave heating construct being for facing away from the food item to be heated, browned, and or crisped.

7. The construct of claim 5, wherein the microwave energy interactive material of the first layer is joined to a support layer such that the microwave energy interactive material of the first layer is disposed between the first polymer film and the support layer.

8. The construct of claim 7, wherein the microwave energy interactive material of the first layer is joined to a first side of the support layer, and the microwave energy interactive material of the second layer is joined to a second side of the support layer opposite the first side.

9. The construct of claim 7, wherein the support layer is a first support layer, and the microwave energy interactive material of the second layer is joined to a second support layer such that the microwave energy interactive material of the second layer is disposed between the second polymer film and the second support layer, wherein the first support layer and the second support layer are joined to one another.

10. The construct of claim 1, wherein the microwave energy interactive material of the first layer and the second layer has an optical density of from about 0.17 to about 0.28.

11. A microwave heating construct, comprising:

a plurality of heating regions including a first heating region and a second heating region, the first heating region comprising a first layer of microwave energy interactive material, and the second heating region comprising the first layer of microwave energy interactive material and a second layer of microwave energy interactive material, wherein the first layer of microwave energy interactive material is substantially continuous, the second layer of microwave energy interactive material comprises a plurality of spaced apart, elongate microwave energy interactive areas comprising the microwave energy interactive material, wherein the elongate microwave energy interactive areas are spaced apart by elongate microwave energy transparent areas comprising the microwave energy interactive material in a deactivated condition, the microwave energy transparent areas have a width of from about 0.10 to about 0.40 inches, and the microwave energy interactive areas of the second layer have a width of from about 0.25 to about 0.75 inches, wherein the second heating region is operative for heating, browning, and/or crisping an adjacent food item to a greater extent than the first heating region.

12. The construct of claim 11, wherein the first layer of microwave energy interactive material is supported on a first polymer film, the first polymer film defining a first side of the microwave heating construct, the first side of the microwave heating construct being for contacting a food item to be heated, browned, and or crisped.

13. The construct of claim 12, wherein the second layer of microwave energy interactive material is supported on a second polymer film, the second polymer film defining a second side of the microwave heating construct, the second side of the microwave heating construct being for facing away from the food item to be heated, browned, and or crisped.

14. The construct of claim 12, wherein the first layer of microwave energy interactive material is joined to a support layer such that the first layer of microwave energy interactive material is disposed between the first polymer film and the support layer.

15. The construct of claim 14, wherein the first layer of microwave energy interactive material is joined to a first side of the support layer, and the second layer of microwave energy interactive material is joined to a second side of the support layer opposite the first side.

16. The construct of claim 14, wherein the support layer is a first support layer, and the second layer of microwave energy interactive material is joined to a second support layer such that the second layer of microwave energy interactive material is disposed between the second polymer film and the second support layer, wherein the first support layer and the second support layer are joined to one another.

17. The construct of claim 11, wherein the first and second layers of microwave energy interactive material each have an optical density of from about 0.17 to about 0.28.

18. The construct of claim 11, wherein the microwave energy transparent areas have a width of about 0.25 inches and the microwave energy interactive areas of the second layer have a width of about 0.50 inches.

19. A method of heating, browning, and/or crisping a food item with varying degrees of intensity, comprising:

placing a food item on a microwave heating construct, the food item having a surface to be browned and/or crisped, the microwave heating construct including a plurality of heating regions including a first heating region and a second heating region, wherein the first heating region comprises a first layer of microwave energy interactive material, the second heating region comprises the first layer of microwave energy interactive material and a second layer of microwave energy interactive material, wherein the first layer of microwave energy interactive material is substantially continuous, and the second layer of microwave energy interactive material comprises a plurality of spaced apart, elongate microwave energy interactive areas comprising the microwave energy interactive material, the elongate microwave energy interactive areas being spaced apart by elongate microwave energy transparent areas comprising the microwave energy interactive material in a deactivated condition, wherein the second heating region is operative for heating, browning, and/or crisping the food item to a greater extent than the first heating region, the microwave energy transparent areas have a width of from about 0.10 to about 0.40 inches, and the microwave energy interactive areas of the second layer have a width of from about 0.25 to about 0.75 inches.

20. The method of claim 19, further comprising exposing the food item on the microwave heating construct to microwave energy, so that the first and second layers of microwave energy convert at least a portion of the microwave energy into heat that heats, browns, and/or crisps the food item.

21. The method of claim 19, wherein the microwave energy transparent areas of the second layer have a width of about 0.25 inches and the microwave energy interactive areas of the second layer have a width of about 0.50 inches.

* * * * *